United States Patent [19]

Hohorst

[11] Patent Number: 4,767,340

[45] Date of Patent: Aug. 30, 1988

[54] CONNECTING CLAMP FOR ELECTRICAL CONDUCTORS

[75] Inventor: Wolfgang Hohorst, Minden, Fed. Rep. of Germany

[73] Assignee: WAGO Verwaltungsgesellschaft mbH, Minden, Fed. Rep. of Germany

[21] Appl. No.: 850,284

[22] Filed: Apr. 10, 1986

[30] Foreign Application Priority Data

Apr. 16, 1985 [DE] Fed. Rep. of Germany ..... 3514097

[51] Int. Cl.[4] ..... H01R 13/05

[52] U.S. Cl. ..... 439/729

[58] Field of Search ..... 339/200 R, 200 P, 204, 339/205, 206 R, 206 P, 207 S, 215 S, 219 R, 244 R, 249 R, 252 R, 253 R, 253 L, 253 S, 256 R, 256 S, 259 R, 75 R, 248 R, 248 S, 208, 75 MP, 75 M

[56] References Cited

U.S. PATENT DOCUMENTS

| | | | |
|---|---|---|---|
| 842,771 | 1/1907 | Cove | 339/249 R |
| 3,596,229 | 7/1971 | Herbert | 339/61 R |
| 4,095,868 | 6/1978 | Luithle | 339/205 |
| 4,270,826 | 6/1981 | Narozny | 339/75 MP |
| 4,443,047 | 4/1984 | Hofman | 339/208 |
| 4,534,610 | 8/1985 | Takihara | 339/259 R |

FOREIGN PATENT DOCUMENTS

| | | | |
|---|---|---|---|
| 8301933 | 7/1983 | Fed. Rep. of Germany . | |
| 3237787 | 3/1984 | Fed. Rep. of Germany | 339/200 R |

*Primary Examiner*—Joseph H. McGlynn
*Attorney, Agent, or Firm*—Salter & Michaelson

[57] ABSTRACT

The invention concerns a connecting clamp for electrical conductors (17, 18) which can be manufactured and assembled automatically as a mass-produced product, in an especially economical manner. This objective is achieved by a clamp without a current bar, where two conductors are simultaneously clamped by a clamping spring (7). Here, each conductor in the insulating housing has its conductor bed (15) or a conductor guide channel (16).

5 Claims, 2 Drawing Sheets

CONNECTING CLAMP FOR ELECTRICAL CONDUCTORS

BACKGROUND

Description of the Prior Art

The invention concerns a connecting clamp for electrical conductors such as are known from the DE-PS No. 27 06 482 of the applicant. Connecting clamps of this type have an insulating housing and a clamping spring that is formed of an elastic flat material. The clamping spring has two legs which terminate in ends, which are bent towards one another in such a fashion that the end of one leg extends through a recess in the end of the other leg. Here an electrical conductor extends underneath the end of the leg that extends through the recess and is conducted through the recess. This conductor is pulled from the lower edge of the recess in the direction of that end of the leg of the clamping spring which extends through the recess.

The known connecting clamps of this type are built with an intrinsically rigid current bar. Together with the electrical conductor, this current bar extends through the recess of one leg end of the clamping spring. Here, the contact point for the electrical conductor is formed between the lower edge of the recess and the current bar. One or also several electrical conductors can be clamped at each contact point. However, such a bundled clamping e.g. of two conductors is disadvantageous since all the conductors are loosened simultaneously when the contact point is opened. Consequently, one tries to provide a separate contact point for each conductor when using connecting clamps for electrical conductors. With the clamp according to the DE-PS No. 27 06 482, this can be achieved only by a corresponding number of clamping springs. Thus the design of such a clamp to connect two or more conductors is relatively expensive.

The DE-AS No. 11 05 937 discloses a connecting clamp for two conductors which makes do with only one clamping spring. However, when assembling the clamp, the second device-side conductor must here be fastened by means of a fastening claw at one leg end of the clamping spring. This is unsuitable for the mass production of such clamps. Furthermore, this clamp provides that, for connecting the device-side conductor, there is a break in the force loop of the clamping spring which weakens the spring force of the clamp.

This disadvantage also exists with the connecting clamp for two conductors according to the DE-GM No. 83 01 933. Here too, there is a break in the force loop of the clamping spring, which is used to fix the clamping spring on the current bar at its correct position. Without such fixing, the clamping forces resulting from clamping the second electrical conductor would move the clamping spring away from the current bar. It is therefore necessary to fix the clamping spring at its correct position, and this considerably increases manufacturing and assembly costs, thus making this clamp essentially unsuitable for mass production.

OBJECTS AND ADVANTAGES

The object of the invention is to create an economical connecting clamp for electrical conductors, which can be manufactured and assembled automatically, and which clamps two electrical conductors independently of one another, if possible with only one clamping spring.

This object is achieved by a connecting clamp of the type defined in the introduction, as follows: Two electrical conductors are disposed above one another in the pulling direction. They can be plugged through the opening in one leg end of the clamping spring. Here, the upper conductor is conducted in a conductor bed that is formed in the insulating housing. That leg end of the clamping spring which extends through over the opening engages the conductor bed and fastens the conductor in its conductor bed, and which has a downwardly open conductor contact surface for contacting the lower conductor with the upper conductor, at least in the area of the contact point.

The clamp according to the invention is a spring-only clamp, i.e. it does not require a current bar. Accordingly, it can be manufactured only from the clamping spring and the insulating housing and in particular without other metallic components, in economical fashion. The double-layered electrical conductors, disposed one above the other, can lie in parallel or can cross at an angle.

With the clamp according to the invention, the upper conductor replaces the current bar that has previously been usual with clamps of this type. Through the downwardly open conductor contact surface of the conductor bed, it directly contacts the lower conductor. Thus, there is only a single current transfer within the clamp. As a result, excellent electrical data can be achieved with the clamp according to the invention.

The contact points of the upper and lower conductor both lie in the area of the opening of one leg end of the clamping spring and are thus situated directly one above the other. Thus, the tilting moments resulting from the conductor clamping do not exist, and it is not necessary to hold the clamping spring in the insulating housing with a constraining mount. Thus it is also impossible to transmit the clamping force to the insulating housing, as is required by electrical safety regulations.

An especial advantage is that, with the clamp according to the invention, each conductor being connected has its own contact point. The upper electrical conductor is clamped through that leg end of the clamping spring which extends through the opening; independently of this, the lower electrical conductor is clamped through that leg end of the clamping spring which has the opening. For exampe, if the leg end with the opening is moved downward through pressure against the clamping spring, and accordingly the contact point for the lower electrical conductor is opened, the clamping point for the upper electrical conductor remains closed independently of this. In similar fashion, the clamping point for the upper electrical conductor can be opened by raising that leg end which extends through the recess, without this impairing the mechanical clamping of the lower electrical conductor.

In very many applications, for instance in house installations or in device technology, a plug-in electrical conductor, e.g. in the form of a solid conductor or a solid pin, must be connected with a flexible electrical conductor. Plug-in conductors can easily be inserted into the upper contact point of the clamp according to the invention; as solid conductors, they also can be conducted very easily into the conductor bed of the clamp. This allows in the conductor bed a larger, downwardly open conductor contact surface with improved contacting of the lower conductor, without the risk that the upper conductor will be pressed out of its conductor bed. On the other hand, with a wide-area conductor contact surface, the lower electrical conductor, which generally is flexible, could be undesirably pressed into the conductor bed, inasmuch as the solid conductor is not yet situated in the conductor bed. Consequently, according to an especially advantageous embodiment of the invention, a catch lever is used to guarantee that it is always the solid conductor that is first introducted into the clamp according to the invention, into the upper contact point, i.e. into the conductor bed, before, after opening the lower contact point, a flexible or solid conductor is clamped into the lower contact point.

This catch lever can be made of insulating material and can be injection-molded integrally with the insulating housing or can be inserted subsequently into an appropriate pocket in the insulating housing. According to an especially preferred embodiment of the invention, the catch lever, in the untensioned state, engages that leg end of the clamping spring which has the opening, i.e. when the lower contact point is closed, it engages the opening of the leg end, whereby the catch lever, which is pivotably mounted in the insulating housing, has its outer free end extending into the conductor bed of the upper contact point. By means of the upper conductor, which is pushed into the conductor bed, it is activated in such a fashion that only after activation will it release that leg end of the clamping spring, which has the recess, to open the lower contact point.

PREFERRED EMBODIMENT OF THE INVENTION

An upwardly and downwardly open conductor bed can be achieved with an especially suitable embodiment of the invention. In this embodiment, the conductor bed consists of two hemispheres, each of which is disposed in one-half an insulating housing that is divided in two in the tension direction of the clamping spring. The hemispheres here do not form a full half circle, so that, after the two halves of the insulating housing are joined, the hemispheres have a distance from one another. Thus it is possible to have access from the top for the leg end of the clamping spring which extends through the opening. At the same time, there is an improved conductor contact surface towards the bottom for the lower electrical conductor.

The two halves of the insulating housing are joined together at one of their outer edges by means of a molded-on hinge. The two of them, together with the hinge portion, are suitable injection molded integrally from insulating material.

BRIEF DESCRIPTION OF THE DRAWINGS

An embodiment of the invention will be described below in more detail by way of the drawings.

Figure 4:
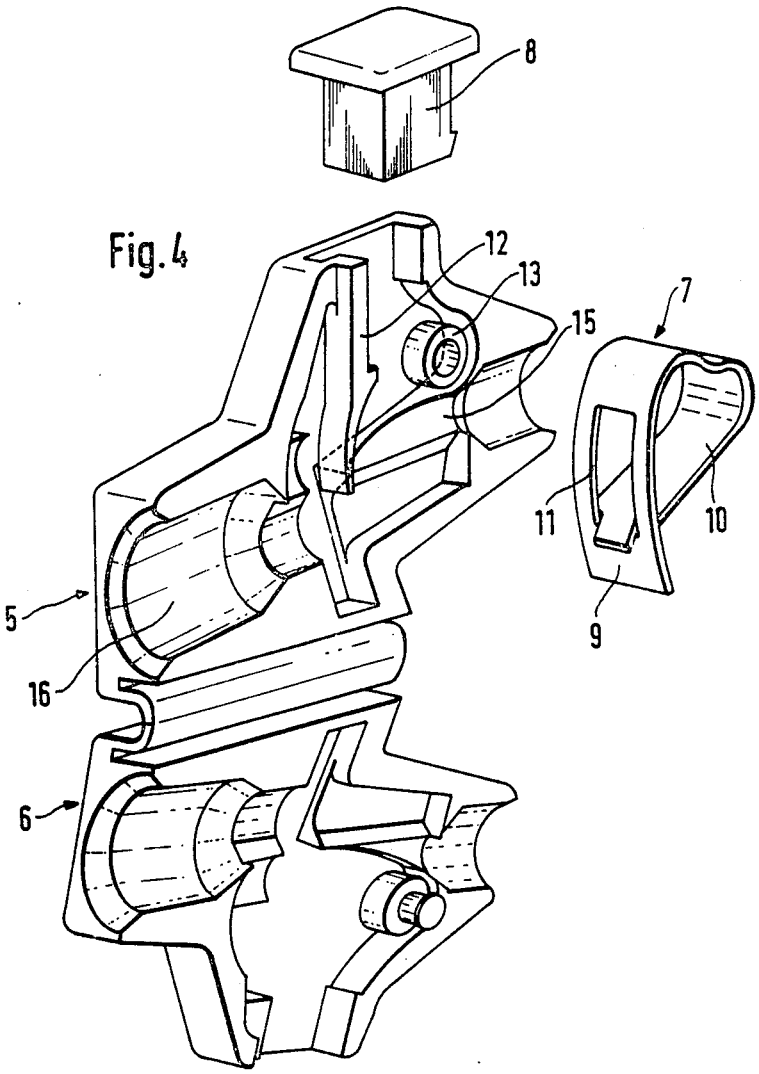
FIG. 4 shows a perspective representation of individual parts of the clamp according to FIG. 1, before assembling the clamp.

As FIG. 4 shows, the clamp shown as an embodiment consists only of three parts, namely the insulating housing, which is injection molded integrally of two mutually hinged halves 5 and 6, made of plastic, the clamping spring 7, and the pressure element 8.

The clamping spring 7 is formed of a flexible flat material and has two leg ends 9 and 10. These are bent towards one another in such a fashion that the one leg end 10 extends through the opening 11 in the other leg end 9. Thus this clamping spring is self-supporting.

Figure 1:
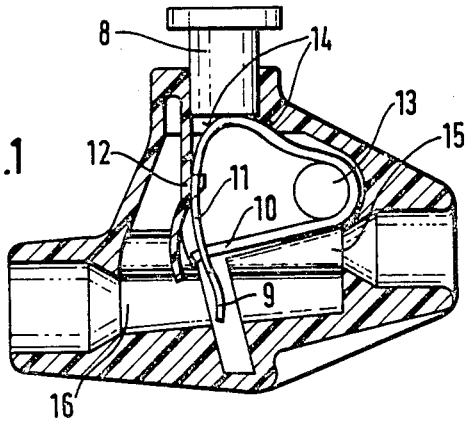
FIGS. 1–3 show longitudinal sections through a clamp according to the invention, in various functional states.

The clamping spring is then inserted, without being under tension, into one half of the opened insulating housing, as shown in FIG. 1. During the insertion process, the catch lever 12 merely needs to be bent back somewhat, so that the clamping spring can freely fall into its receptacle in its part of the housing. This is appropriate for automatic operation. After the catch lever 12 springs back, the clamping spring is fixed in position, and specifically through its holding peg 13, its head contact 14, and through the catch lever 12 which engages the opening 11.

FIG. 1 together with FIG. 4 furthermore show the conductor bed 15 for the upper electrical conductor, consisting of two hemispheres, which respectively are formed into one of the halves 5 and 6 of the insulating housing. The conductor guide channel 16 for the lower electrical conductor is situated below the conductor bed. The halves 5 and 6 of the housing are snapped together after the clamping spring is inserted and interlock with one another. The pressure element 8 merely needs to be inserted from the top, in order to put the clamp into its ready-to-use final condition.

Figure 2:
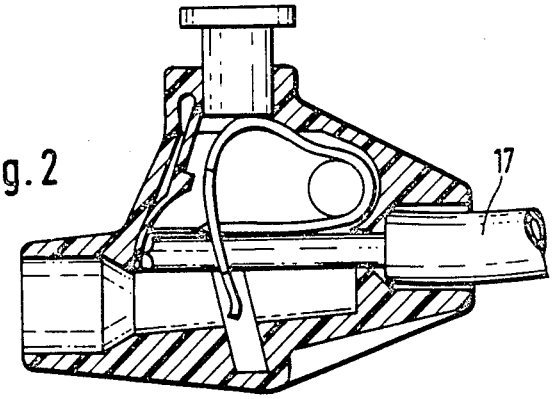

When the clamp is being used, the upper electrical conductor—which must be a plug-in solid conductor 17 in the embodiment shown—must first be inserted into the lower conductor bed 15, as shown in FIG. 2. When the solid conductor 17 is inserted, the clamping spring's leg end 10, which engages the conductor bed, springs back and its end grasps the surface of the solid conductor that is plugged into the conductor bed 15.

When the solid conductor is inserted, the catch lever 12 is simultaneously pushed back by the solid conductor, into a position as shown in FIG. 2. In this position of the catch lever, the clamping spring's leg end 9, which has the opening 11, is released for being pressed down by means of the pressure element 8. Only now is it possible, by depressing the pressure element, to open the lower contact point of the clamp, and to insert and clamp e.g. the flexible conductor 18 into the conductor guide channel 16, as shown in FIG. 3.

Figure 3:
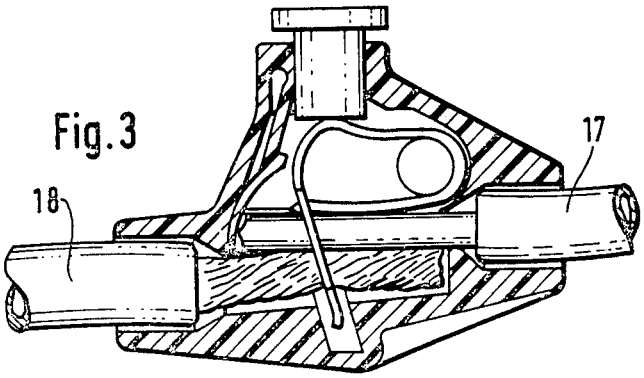

FIG. 3 shows that, as a consequence of the spacing between the hemispheres of the conductor bed 15, the conductor bed 15 has a downwardly open conductor contact surface, which makes it possible for the upper solid conductor 17 and the lower flexible conductor 18 to make direct contact.

By pressing down the pressure element 8 and opening the lower contact point, it is easily possible to loosen the flexible conductor 18. Here, the upper solid conductor 17 remains clamped and cannot slide out of the contact point unintentionally. Such clamps are therefore excellently suited for all voltage-carrying electrical conductors, plugs, or the like, which need only be equipped with the clamp according to the invention so that their voltage-carrying ends are covered safe against contact.

I claim:

1. A connecting clamp for electrical conductors, comprising an insulating housing having a front portion that is formed with a first conductor guide channel for receiving a first conductor therein and a rear portion that is formed with a second conductor guide channel for receiving a second conductor therein, a clamping spring located in said housing formed of a flat, flexible material, said clamping spring including a first leg that is located adjacent to the front portion of said housing and having an opening formed therein defined by an upper edge and a lower edge, a second leg joined to said first leg and being bent relative thereto to form a spring loop having a closed face that is located adjacent to the rear portion of said housing, said second leg of said clamping spring including a free end that extends through said opening in said first leg, both said first and second conductors extending through said opening in the first leg of said clamping spring in parallel relation but in opposite directions relative thereto, said conductors being disposed one on top of the other in electrical engaging relation, said second guide channel including means for positively locating said second conductor therein, wherein said second conductor is exposed to said second leg along its upper surface thereof and is also exposed to said first conductor along its lower surface to form an electrical contact with the first conductor, the free end of said second leg of said clamping spring engaging the upper surface of said second conductor to secure said second conductor against pullout forces if applied to the second conductor, the lower edge of said opening in said first leg of said clamping spring urging said first conductor into direct and firm electrical contact with said second conductor.

2. A connecting clamp as claimed in claim 1, a pressure element extending into said housing and engaging said clamping spring adjacent to said first leg, said pressure element being operable upon a downward force exerted thereon to force said first leg downwardly to exert a tension force on said second leg as it engages said second conductor and provide access of said first conductor into said opening, whereupon release of said pressure element causes said lower edge of said opening in said clamping spring to positively engage the underside of the first conductor.

3. A connecting clamp as claimed in claim 1, a pivotally mounted catch lever located in said housing and locking the first leg of said clamping spring by engaging said first leg at the upper edge of the opening therein in a position in which the first conductor cannot be inserted into the first conductor guide channel, said catch lever being urged away by the second conductor for releasing said first leg of the clamping spring when said second conductor has been inserted into the second conductor guide channel.

4. A connecting clamp as claimed in claim 1, said locating means in said second conductor guide channel being defined by opposed arcuate portions that receive said second conductor therebetween, and openings formed in said arcuate portions for exposing the surfaces of said second conductor as located between said arcuate portions.

5. A connecting clamp as claimed in claim 4, a molded unitary hinge integrally connecting each half of said housing to the other and being molded in a one piece construction therewith.

* * * * *